United States Patent [19]

Müessli

[11] Patent Number: 4,961,027

[45] Date of Patent: Oct. 2, 1990

[54] DISCHARGE LAMP HAVING A STANDARDIZED BASE

[75] Inventor: Daniel Müessli, Ulmiz, Switzerland

[73] Assignee: Skyline Holding AG, Ulimz, Switzerland

[21] Appl. No.: 364,456

[22] Filed: Jun. 12, 1989

[30] Foreign Application Priority Data

Jun. 13, 1988 [FR] France ..... 88 07981

[51] Int. Cl.[5] ..... H01J 7/44

[52] U.S. Cl. ..... 315/58; 315/51; 315/53; 315/DIG. 5

[58] Field of Search ..... 315/58, DIG. 5, 62, 315/57, 63, 51, 53

[56] References Cited

U.S. PATENT DOCUMENTS

| | | | |
|---|---|---|---|
| 4,173,730 | 11/1979 | Young et al. | 315/DIG. 5 |
| 4,270,071 | 5/1981 | Morton | 315/58 |
| 4,623,823 | 11/1986 | Engel | 315/58 |
| 4,683,402 | 7/1987 | Aubrey | 315/58 |
| 4,688,874 | 8/1987 | Bjorkman | 439/56 |
| 4,695,767 | 9/1987 | Wittmann | 315/58 |
| 4,761,585 | 8/1988 | Linnman et al. | 315/58 |
| 4,857,806 | 8/1989 | Nilssen | 315/58 |

FOREIGN PATENT DOCUMENTS

| | | |
|---|---|---|
| 8300259 | 1/1983 | PCT Int'l Appl. . |
| 8803702 | 5/1988 | PCT Int'l Appl. . |

*Primary Examiner*—Eugene R. LaRoche
*Assistant Examiner*—Son Dinh
*Attorney, Agent, or Firm*—Griffin, Branigan & Butler

[57] ABSTRACT

This illumination lamp (5) includes a discharge tube (6, 7), a standardized base (10) and an intermediate element (9) arranged between the tube and the base. The lamp is characterized in that an electronic circuit (32) transforming the low frequency of the distribution network into a high frequency for energizing the tube is entirely electronic circuit is made up of a printed circuit in the form of a disc (30) bearing vertically arranged circuit components. The lamp, which is of greatly reduced dimensions is intended to replace an incandescent lamp.

11 Claims, 4 Drawing Sheets

DISCHARGE LAMP HAVING A STANDARDIZED BASE

This invention concerns a lamp for illumination purposes including at least one low pressure discharge tube, a standardized base intended to be screwed or introduced into a socket connected to an electricity distribution network, an electronic circuit for transforming the low frequency of the distribution network into high frequency for energizing the tube and an intermediate element arranged between the tube and the base.

BACKGROUND OF THE INVENTION

During the last several years efforts have been made to replace incandescent lamps by low pressure discharge tubes, the term "replace" here being understood to mean a direct interchangeability. There thus have been proposed fluorescent tubes having a standardized base for instance of the screw-in or bayonet type which can be directly inserted into a standardized socket. Since such a tube may not be directly connected to the network, if only because of the high voltage necessary to trigger the arc in the lamp as well as the necessity to limit lamp current following triggering, the low pressure lamps commercially available are far bulkier and heavier than the incandescent lamps which they are supposed to replace As evidence thereof one may read with interest the patent document GB-A-2 072 942 which describes an example of a low pressure lamp including a heavy inductive ballast enclosed within a translucent housing comprising two U formed fluorescent tubes. The entire structure is terminated by a base of the type E 27 which is screwed directly into a socket of the type which may also receive an ordinary incandescent lamp.

In order to minimize the difficulty presented by the weight and partially that of the bulk, there has been proposed an electronic circuit which transforms the low frequency of the distribution network (sole energization of the lamp in the above-cited document) into a high frequency for energizing the tube. This is the case in the example of the lamp shown on the drawing in FIG. 1 which illustrates a lamp sold by the Osram Company under the registered trademark "DULUX EL" The energization at high frequency (on the order of 35 kHz) enables a reduction in the size of the passive components such as that of the current limiting inductive ballast. Thus, the lamp 1 shown on FIG. 1 includes a fluorescent tube 2 and a base 3, tube and base being united by an intermediate element 4. The tube is of a well-known type such as described for instance in the patent document GBA-2 050 046. The intermediate element 4 in addition to mechanically coupling the tube to the base contains an electronic circuit for raising the energization frequency as well as a ballast and a starter for limiting the current in the tube and respectively triggering the arc. The intermediate element likewise contains an arrangement for eliminating radio-frequency parasitic noise. This latter arrangement mainly includes a double self coupled by a ferromagnetic core arranged in series with the energization of the electronic circuit. Such double self, although not reaching the weight and bulk of the ballast employed for direct energization from the network, nevertheless occupies a relatively substantial volume which necessitates an intermediate element 4 of relatively large diameter in any case double that exhibited by the base.

Efforts have been made to further diminish the bulk of the intermediate element 4. Such is the case for the fluorescent lamp described in the international patent application WO 88/03 702. Here the energization circuit for the tube is entirely confined within the standardized base of the lamp However, this energization lacks an electronic frequency converter and the lamp is energized at the frequency of the distribution network (50 or 60 Hz). The ballast is a simple capacitor shunted by a high value resistor. As example, one may cite the value of 2 $\mu$F for the capacitor and 150 k$\Omega$ for the resistor. The inventor of the lamp described in document WO 88/03 702 indicates moreover that a transistorized electronic ballast is highly fragile and occupies substantial volume which leaves one to conclude that it will not be capable of being housed in the lamp base. It will be shown in the description to follow that this conclusion is not correct and that it is perfectly possible in the present state of the art and with a good margin of security to confine an electronic energization circuit within the lamp base. On the other hand, the arrangement suggested in the last cited document includes several difficulties. It exhibits initially a very low power factor (cos$\phi$ substantially less than 0.2) which can be compensated only by a large volume self which in any case would be impossible to place within the base. Numerous countries will forbid the sale of such a lamp if the power factor is not compensated Furthermore, the ballast capacitor typically of two $\mu$F must withstand almost the entire network voltage This requires a large volume capacitor, one which in any case would be provided for energization at 220 VAC and which may not be placed within the lamp base without assuming risks inacceptable in certain countries where safety regulations must be observed to avoid prohibition of sale.

SUMMARY OF THE INVENTION

To overcome the difficulties as mentioned and to provide a low pressure discharge lamp of greatly reduced dimensions, the illumination lamp in accordance with the invention in addition to providing an electronic circuit which transforms the low frequency of the distribution network into high frequency, is characterized in that at least the electronic circuit is entirely contained within a standardized base.

The invention will now be explained with the aid of the description to follow given by way of example and referring to the accompanying drawings.

DESCRIPTION OF THE PREFERRED EMBODIMENT

Figure 3:
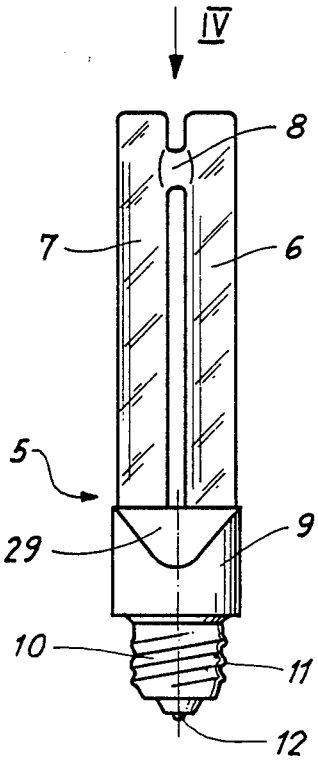
FIG. 3 is a view along arrow III of figure 2.
Figure 2:
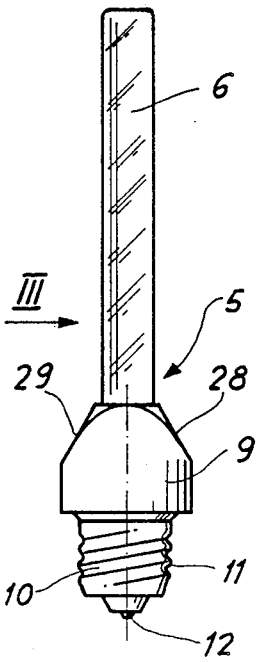
FIG. 2 is a view of the discharge lamp according to the invention presented in a first embodiment thereof.
Figure 4:
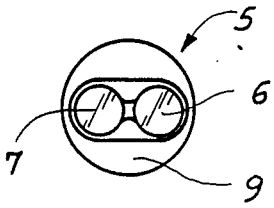
FIG. 4 is a top view of the lamp of the invention along the arrow IV of FIG. 3.

FIGS. 2, 3 and 4 are assembled views of the discharge lamp according to the invention. Such lamp 5 includes a low pressure discharge tube comprising two branches 6 and 7 coupled by an isthmus 8. This tube, realized for instance in accordance with the already cited document G-A-2 050 046, contains as is well known mercury vapour at low pressure and its internal wall is coated with a fluorescent substance. The lower parts of the branches 6 and 7 are introduced into an intermediate element 9 into which they are sealed. A standardized base 10 of the Ectype including a metallic shell 11 with screw threads and a central electrode 12 is fastened in any suitable manner to the intermediate element 9. This base is intended to be screwed into a socket likewise standardized, such socket being coupled to an electric distribution network furnishing for instance 220 VAC/50 Hz. The lamp such as described further includes an electronic circuit transforming the low frequency of the distribution network into high frequency for energizing the tube. In accordance with the invention, this electronic circuit is entirely contained within the interior of the standardized base 10.

More specifically and according to a preferred embodiment of the invention, FIGS. 2 and 3 show that the intermediate element 9 exhibits a cylindrical form of which the outer diameter and the height are substantially equal to the diameter and height respectively of the base 10.

Figure 5:
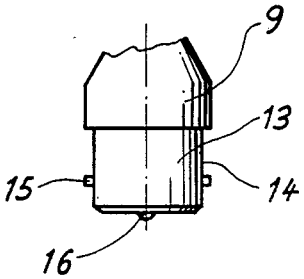
FIG. 5 is a partial view of the discharge lamp of the invention according to a second embodiment thereof.

FIG. 5 which is a partial view of the lamp according to the invention shows that the invention is not limited to the use of a screw type base E27. Here is shown a base 13 of the bayonet type B22d including a smooth metallic shell 14 provided with two studs 15 and a central electrode 16. This base 13 is secured to an intermediate element 9 similar to that described above, such element bearing a tube not shown.

Figure 6:
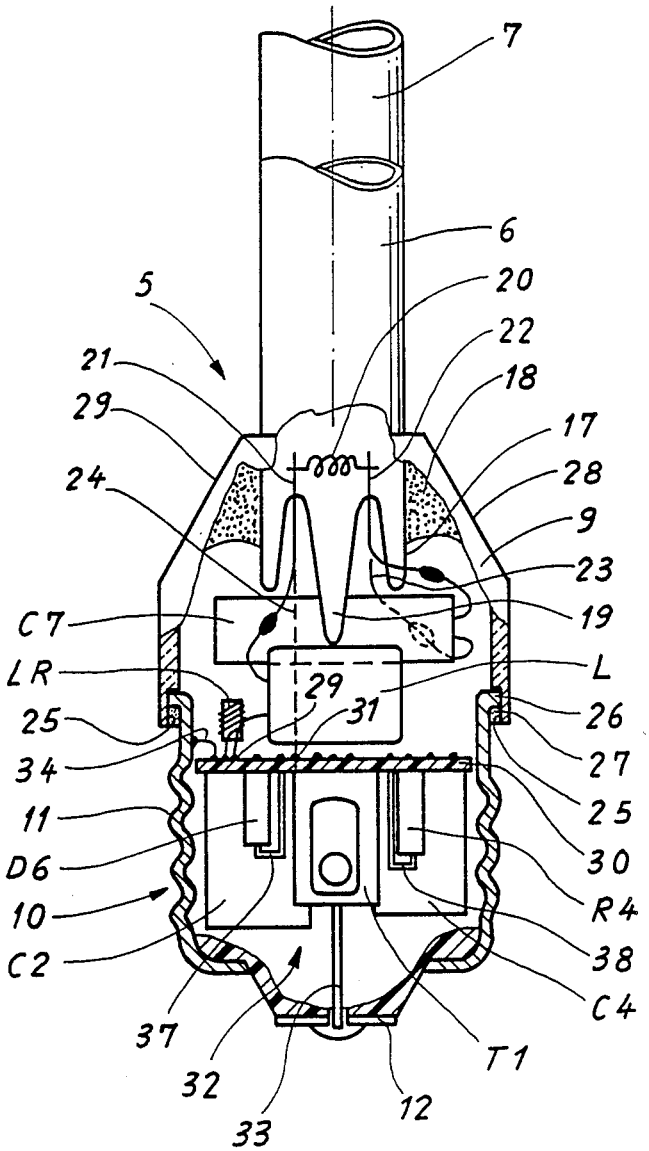
FIG. 6 shows to an enlarged scale the interior of the lower part of the lamp shown on FIG. 2.

FIG. 6 shows to an enlarged scale the interior of the lower part of lamp 5. On this figure will be found branches 6 and 7 of the discharge tube, the intermediate element 9 and the base 10. The figure shows that the end 17 of the branch 6 of the discharge tube is sealed by means of cement 18 to the interior of the intermediate element 9. This is likewise the case for the end of branch 7 which does not appear on the drawing In a well known manner, the end 17 is shut off by a constriction 19 and includes a filament 20 forming one of the electrodes of the tube. The filament is borne on wires 21 and 22 which traverse the glass of the tube. Another filament is arranged in the same manner at the end of branch 7 and the wires coming out from this other filament are referenced 23 and 24. Intermediate element 9 also includes an interior annular groove 25 in which is accommodated the enlarged flange 26 exhibited by the base 10. The intermediate element 9 and base 10 are fixed relative to one another by means of glue or cement 27 which is placed in groove 25.

FIGS. 2, 3 and 6 show that the lamp is formed by a tube having two branches 6 and 7. In this case one may improve the appearance of the lamp in interrupting the cylindrical form of the intermediate element by two inclined surfaces 28 and 29 which open in the form of a roof in the direction of base 10. Such an arrangement lightens considerably the general form of the lamp. Also, to a certain extent the surfaces 28 and 29 enable an easier grasping of the lamp when it is to be introduced into its supporting socket.

Returning now more specifically to FIG. 6, it will be seen that the intermediate element (preferably formed of insulating material, for example ceramic) contains a current limiting element L and a starter C7. The starter C7 is connected between the outputs 22 and 23 of the tube and is located between the constrictions of branches 6 and 7. The limiter element L is located to the front of the figure and is connected in series between the output 21 of branch 7 and a point 29 of a printed circuit 30 which will be described subsequently. The output 24 of tube 7 is connected to a point 31 of the same printed circuit.

In the base 10 of the lamp is placed according to a basic characteristic of the invention the electronic circuit generally designated by 32. The main task of this electronic circuit is to transform the low frequency of the network (50 or 60 Hz) to high frequency for energizing the discharge tube. FIG. 6 clearly shows that circuit 32 is entirely contained in the standardized base 10 (here of the type Edison E27). The electronic circuit 32 includes a printed circuit 30 exhibiting the form of a disc (see also FIG. 8), the diameter of which is substantially less than the inner diameter of base 10. Onto this disc are vertically mounted the electronic components such as the transistor T1, the diode D6, the resistor R4 and the capacitors C2 and C4 which alone are visible on figure 6 and which form a portion of the total schematic shown on FIG. 7. Electronic circuit 32 is connected to the energizing network by conductor 33 which is soldered to the electrode 12 of base 10 and by conductor 34 which is soldered to the shell 11 of the same base 10.

Figure 8:
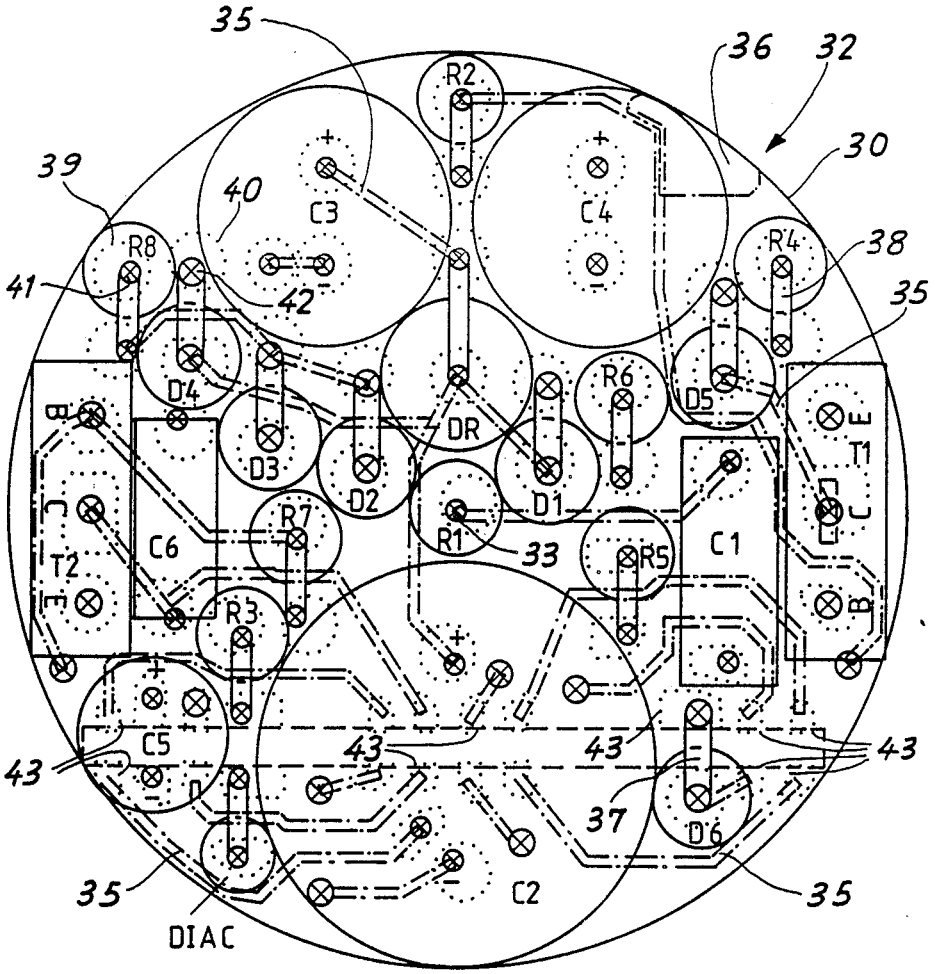
FIG. 8 is a detail drawing showing how the electronic components of the schematic of FIG. 7 are placed on a printed circuit

FIG. 8 shows the details of how the electronic circuit 32 is organized. This circuit comprises a printed circuit 30 as already mentioned. The electronic components are all with a single exception located on one face of the printed circuit and in FIG. 8 face the observer T designates the transistors with their terminals B, C, E, D the diodes, DR an inductance, C the capacitors and R the resistors. The printed circuit 30 provides conductors on both faces. On FIG. 8 only the conductors printed on the opposite face appear in mixed traces (references 35) so as not to overcharge the drawing. At the center of the figure is located resistor R1 The wire which emerges therefrom bearing reference 33 on the side of the observer is directly connected to electrode 12 of the base as already shown on FIG. 6. To area 36 is soldered wire 34 which connects the printed circuit to the shell of the base, this wire being shown on FIG. 6. The outputs of components which provide connection wires situated on the side of the printed circuit traverse directly openings through the disc 30. This is the case for instance of transistors T1 and T2 and capacitors C2, C3 and C4. On the other hand the resistors R2, R3 etc. and the diodes D1, D2 etc. all show a connection wire which is folded along the component before being soldered onto the printed circuit. This is the case for instance for diode D6 and resistor R4 each showing a wire referenced 37 and 38 respectively.

The conductors printed onto disc 30 include metallic points pierced with openings into which are soldered the conductors of the various electronic components. This is the case for instance of metallic points 39 and 40 which receive respectively the components R8 and D4, such points being pierced by openings 41 and 42 respectively According to an embodiment of this invention, it will be noticed that the piercings 41 and 42 are not at the center of the metallic points 39 and 40, but are displaced relative to such centers, this in order to avoid short circuits between adjacent solderings. FIG. 8 further shows other places where such an arrangement is practised. Thus when one proceeds to soldering the components, either by hand or by machine, there will be no solder bridges between points which must remain insulated from one another In spite of the relatively large number of components in the electronic circuit, it is seen that the judicious arrangement of such components relative to one another enables housing the entire circuit within the standardized base of the lamp. The components are prepared ahead of time in respect of the lengths and folds of the connecting wires, preferably by means of a machine. They are then arranged on the disc 30 by means of a robot specifically developed for this purpose. One thus may obtain an inexpensive module, this being most important for a mass produced product.

Figure 7:
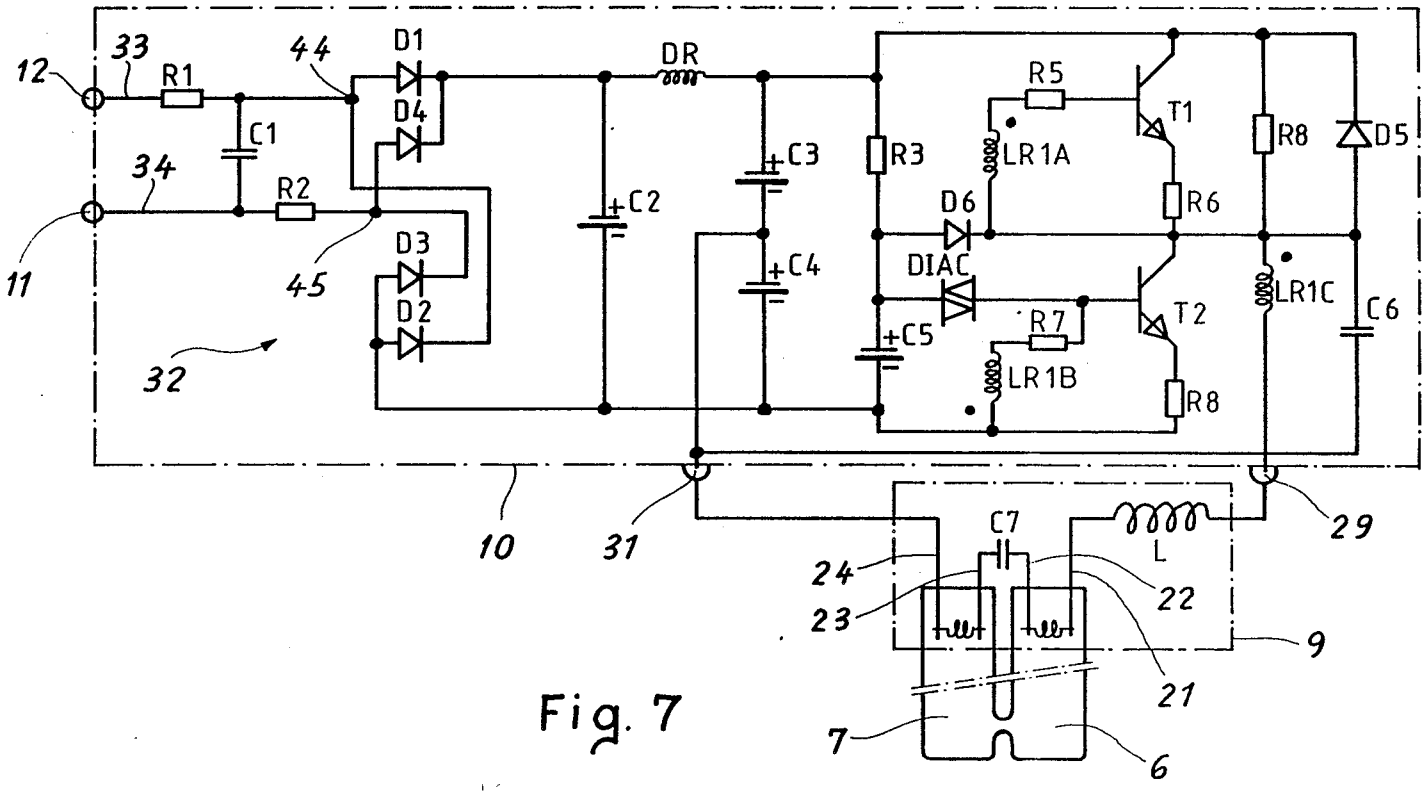
FIG. 7 is a schematic diagram of the electronic circuit showing the energization of the lamp according to the invention.

FIG. 7 is an electronic schematic of the circuit corresponding to the placement illustrated on FIG. 8. The electronic circuit 32 is entirely confined to the interior of base 10 shown on FIG. 7 by a frame formed of mixed traces. Terminals 11 and 12 represent respectively the metal shell and the central electrode of the base. Points 29 and 31 represent the connection terminals of the outputs of the electronic circuit, such outputs being coupled to the intermediate element 9 (also shown on FIG. 7 by a frame formed of mixed traces) in which is found the current limiting element L, starter C7 and the ends of the discharge tube. Said tube emerges from the intermediate element 9 with its branches 6 and 7.

Figure 1:
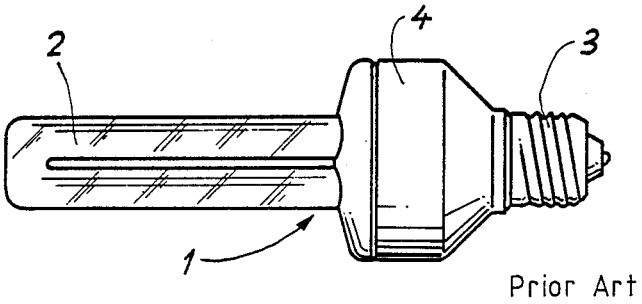
FIG. 1 shows a discharge lamp according to the prior art and which has been described in the introduction to this description.

In its general principle, the schematic of FIG. 7 is well known. From the state of the art such as practised in the case of the Osram lamp discussed above in respect of FIG. 1 or in the lamp of the Philips Company which bears the denomination "PLC 20 Electronic". The circuit generally includes an oscillator comprising two transistors T1 and T2 reactively coupled by an element formed of three windings LR1A, LR1B and LR1C wound around a common core. This element is shown on FIG. 6 by the reference LR and is located on the solder side of disc 30. It is thus not shown on FIG. 8, except by a certain number of the connection points referenced 43 at which end up the inputs and outputs of windings which may be wound on a ferrite torus. The oscillator already known furnishes a frequency generally in the range between 30 and 40 kHz and energizes the discharge tube. Its operation will thus not be herein described in detail.

The oscillator is energized by direct current by means of a Graetz bridge formed of diodes D1 to D4. To avoid reinjection of low frequency harmonic components into the network, the Graetz bridge energizing the lamp in accordance with the invention is connected to the network via a resistance R1, R2 arranged in series between each of the inputs 44 and 45 of said bridge and the inputs 12, 11 of said network, a capacitor C1 being arranged in parallel with the lines of the network. Typically, according to the invention, resistances R1 and R2 have a value of 15 Ω and capacitor C1 a value 33 nF.

In order to avoid reinjection into the network of radio frequency signals originating in the oscillator, the Graetz bridge energizing the lamp according to the invention is followed by a filter in $\pi$ including an inductance DR in the horizontal branch (typically 820 $\mu$H) and a capacitor C2, C3 +C4) in each of its vertical branches (typically 2.2 $\mu$F. and 2.2+2.2 F.). Thanks to this filter, parasitic components are rejected below the level allowed by international standards (in particular German standards VDE 0875 part 2) in the radio frequency band extending from 0.01 to 30 MHz. This last arrangement furthermore enables elimination of the heavy noise eliminating arrangement mentioned hereinbefore in respect of the Osram lamp DULUX EL. It also enables utilization of capacitors C2 to C4 of smaller diameter instead of a single more voluminous capacitor as employed in the prior art.

The lamp the realization of which has been given here as example includes a tube having two branches 6, 7. The invention is not limited to two branches and the tube could likewise have four for instance. In such case it will be possible with equal luminosity to diminish the overall length of the lamp, thus to approximate the length of an incandescent lamp. In such case the intermediate element 9 would exhibit an essentially cylindrical aspect without inclined surfaces as has been described above.

The description which has just been given of the lamp in accordance with the invention gives assurance that it is perfectly possible in contrast to previously held ideas to contain an electronic energization circuit entirely within the base of the lamp. Such an arrangement permits one to offer a lamp of reduced volume and weight. The cost thereof is likewise minimized with reference to known lamps and this among other reasons because of utilization of machines enabling automatization of the assembly

What I claim is:

1. An illumination lamp including at least one low pressure discharge tube, a standardized base intended to be screwed or otherwise introduced into a socket connected to an electrical distribution network, an electronic circuit transforming the low frequency of the distribution network into high frequency for energizing the tube and an intermediate element arranged between the tube and the base wherein the electronic circuit at least is entirely contained within the standardized base.

2. A lamp as set forth in claim 1 wherein the standardized base is of the screw type E27.

3. A lamp as set forth in claim 1 wherein the standardized base is of the bayonet type B22d.

4. A lamp as set forth in claim 1 wherein the electronic circuit includes a printed circuit in the form of a disc the diameter of which is substantially less than the inner diameter of the base and on which are mounted electronic components (R,T,C) adapted to transform the low frequency of the distribution network into high frequency for energizing the tube.

5. A lamp as set forth in claim 4 wherein the disc provides conductors on both faces, such conductors including metallic points pierced with openings into which are soldered the conductors of the electronic components, certain of said openings being displaced from the centers of the metallic points so as to avoid short circuits between adjacent solder joints.

6. A lamp as set forth in claim 1 wherein the intermediate element is of substantially cylindrical form, the outer diameter and height thereof being substantially equal to the diameter and height of the base respectively

7. A lamp as set forth in claim 6 wherein the ends of the discharge tube are sealed by means of cement into the intermediate element, said element including an interior annular groove which receives an expanded flange exhibited by the top of the base

8. A lamp as set forth in claim 6 wherein the intermediate element receives a discharge tube having two branches, the cylindrical form of said intermediate element being interrupted by two inclined surfaces expanding in the form of a roof toward the base.

9. A lamp as set forth in claim 6 wherein the intermediate element contains a current limiting component.

10. A lamp as set forth in claim 6 wherein the intermediate element contains a starter

11. A lamp as set forth in claim 1 wherein the electronic circuit includes a Graetz bridge connected to the supply network via a resistor arranged in series between each of the inputs of said bridge and said network, a capacitor being arranged in parallel with the lines of the network, 6 said bridge being followed by a $\pi$ filter including an inductance in its horizontal branch and a capacitor in each of its vertical branches.

* * * * *